US010414186B2

(12) United States Patent
Vandre et al.

(10) Patent No.: US 10,414,186 B2
(45) Date of Patent: Sep. 17, 2019

(54) PROCESS FOR DEPOSITING DRY POWDER PARTICLES ONTO A SUBSTRATE AND ATTACHING THE PARTICLES TO THE SUBSTRATE

(71) Applicant: 3M INNOVATIVE PROPERTIES COMPANY, St. Paul, MN (US)

(72) Inventors: Eric A. Vandre, Minneapolis, MN (US); Matthew S. Stay, Minneapolis, MN (US); Matthew R. D. Smith, Woodbury, MN (US); Ann M. Gilman, Woodbury, MN (US); Shawn C. Dodds, St. Paul, MN (US); Jon E. Dable, Lakeville, MN (US); Evan D. Brutinel, Inver Grove Heights, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 16/063,472

(22) PCT Filed: Dec. 12, 2016

(86) PCT No.: PCT/US2016/066165
§ 371 (c)(1),
(2) Date: Jun. 18, 2018

(87) PCT Pub. No.: WO2017/106098
PCT Pub. Date: Jun. 22, 2017

(65) Prior Publication Data

US 2019/0030938 A1 Jan. 31, 2019

Related U.S. Application Data

(60) Provisional application No. 62/269,725, filed on Dec. 18, 2015.

(51) Int. Cl.
*B41M 1/12* (2006.01)
*B41M 1/22* (2006.01)
*B41M 1/26* (2006.01)

(52) U.S. Cl.
CPC ..... *B41M 1/125* (2013.01); *B41M 1/12* (2013.01); *B41M 1/22* (2013.01); *B41M 1/26* (2013.01)

(58) Field of Classification Search
CPC ..... B41M 1/22; B41M 1/12; B41M 1/125
See application file for complete search history.

(56) References Cited

U.S. PATENT DOCUMENTS 2,152,077 A 3/1939 Meston
3,426,730 A 2/1969 Lawson
(Continued)

FOREIGN PATENT DOCUMENTS

DE 2438486 A * 2/1976 ..... B05D 1/28
EP 1755893 2/2007
(Continued)

OTHER PUBLICATIONS

"Encyclopedia of Polymer Science and Engineering", Wiley-Interscience Publishers New York, 1988, vol. 13, 3pgs.
(Continued)

*Primary Examiner* — Jennifer S Simmons
(74) *Attorney, Agent, or Firm* — Kenneth B. Wood

(57) ABSTRACT

Methods for using a hollow, rotating stencil roll to deposit flowable dry powder particles onto a moving substrate and to attach the particles to the substrate.

20 Claims, 6 Drawing Sheets

(56) References Cited

U.S. PATENT DOCUMENTS

| | | | | |
|---|---|---|---|---|
| 6,155,165 | A | 12/2000 | Kaule | |
| 7,442,480 | B2 | 10/2008 | Kanamaru | |
| 2004/0018802 | A1* | 1/2004 | Welygan ..... | B24D 3/002<br>451/28 |
| 2004/0112231 | A1 | 6/2004 | Mori | |
| 2011/0063374 | A1 | 3/2011 | Rea | |
| 2015/0232646 | A1 | 8/2015 | Walker, Jr. | |

FOREIGN PATENT DOCUMENTS

| | | |
|---|---|---|
| WO | WO 2003/041877 | 5/2003 |
| WO | WO 2004/011196 | 2/2004 |
| WO | WO 2015-123526 | 8/2015 |
| WO | WO 2017-106613 | 6/2017 |

OTHER PUBLICATIONS

"The Industrial Solutions Company", [online], [retrieved from the internet on Aug. 16, 2018], URL <http://www.tps-technopartner.de/english/?Scattering_units:Scattering_with_rotary_screen>, 2 pgs.

Satas, Handbook of Pressure-Sensitive Adhesive Technology, 172-173 (1989).

International Search Report for PCT International Application No. PCT/US2016/066165, dated Mar. 15, 2017, 3pgs.

* cited by examiner

PROCESS FOR DEPOSITING DRY POWDER PARTICLES ONTO A SUBSTRATE AND ATTACHING THE PARTICLES TO THE SUBSTRATE

BACKGROUND

Particles are often disposed on substrates for a variety of purposes, for example as spacers, to produce retroreflective articles, to produce abrasive articles, to produce scratch and sniff articles, and so on.

SUMMARY

In broad summary, herein are disclosed methods for using a hollow, rotating stencil roll to deposit flowable dry powder particles onto a moving substrate and to attach the particles to The substrate. These and other aspects will be apparent from the detailed description below. In no event, however, should this broad summary be construed to limit the claimable subject matter, whether such subject matter is presented in claims in the application as initially filed or in claims that are amended or otherwise presented in prosecution.

Figure 1:
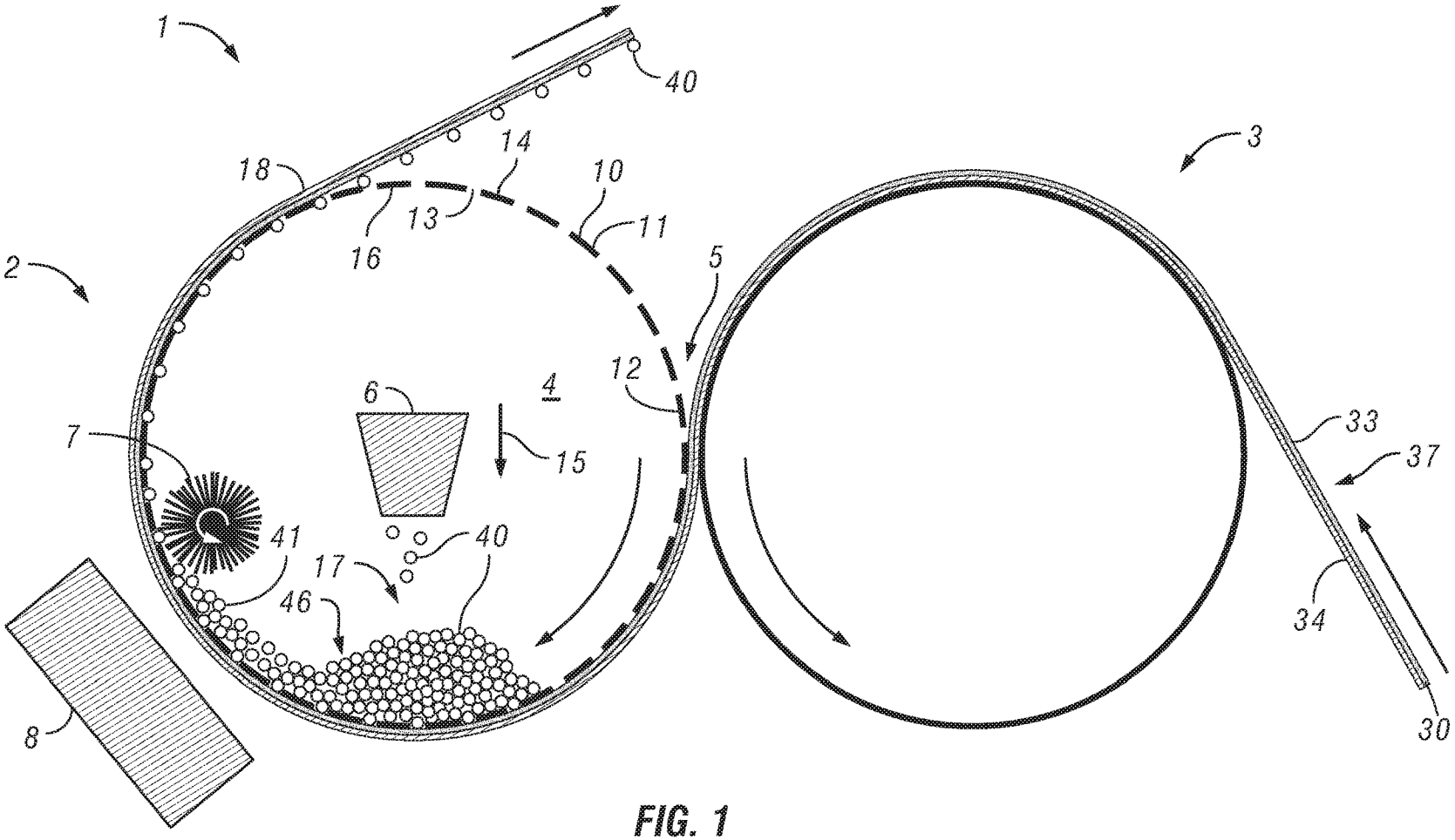
FIG. 1 is a side schematic cross sectional view of an exemplary apparatus and process that can be used to deposit flowable dry powder particles onto a moving substrate.

Like reference numbers in the various figures indicate like elements. Some elements may be present in identical or equivalent multiples; in such cases only one or more representative elements may be designated by a reference number but it will be understood that such reference numbers apply to all such identical elements. Unless otherwise indicated, all figures and drawings in this document are not to scale and are chosen for the purpose of illustrating different embodiments of the invention. In particular the dimensions of the various components are depicted in illustrative terms only, and no relationship between the dimensions of the various components should be inferred from the drawings, unless so indicated. Terms such as "top", bottom", "upper", lower", "under", "over", "up" and "down", and the like, are used in their conventional sense with respect to the Earth's gravity.

As used herein as a modifier to a property or attribute, the term "generally", unless otherwise specifically defined, means that the property or attribute would be readily recognizable by a person of ordinary skill but without requiring a high degree of approximation (e.g., within +/−20% for quantifiable properties). For angular orientations, the term "generally" means within clockwise or counterclockwise 30 degrees. The term "substantially", unless otherwise specifically defined, means to a high degree of approximation (e.g., within +/−10% for quantifiable properties). For angular orientations, the term "substantially" means within clockwise or counterclockwise 10 degrees. The term "essentially" means to a very high degree of approximation (e.g., within plus or minus 1% for quantifiable properties; within plus or minus 2 degrees for angular orientations); it will be understood that the phrase "at least essentially" subsumes the specific case of an "exact" match. However, even an "exact" match, or any other characterization using terms such as e.g. same, equal, identical, uniform, constant, and the like, will be understood to be within the usual tolerances or measuring error applicable to the particular circumstance rather than requiring absolute precision or a perfect match. Those of ordinary skill will appreciate that as used herein, terms such as "essentially free of", and the like, do not preclude the presence of some extremely low, e.g. 0.1% or less, amount of material, as may occur e.g. when using large scale production equipment subject to customary cleaning procedures. All references herein to numerical parameters (dimensions, ratios, and so on) are understood to be calculable (unless otherwise noted) by the use of average values derived from a number of measurements of the parameter.

DETAILED DESCRIPTION

Glossary

By flowable dry powder particles is meant particles that are at least substantially free of liquid and that can flow freely in a dry state, e.g. as motivated by gravity. Specifically, by dry powder is meant that the particles are in the form of a conventional powder rather than as a dispersion, suspension, paste, plastisol, emulsion or the like in a liquid. The term dry does not imply that the particles must be completely free of trace amounts of moisture as may be typically present in many powders.

By dispersing is meant passively distributing flowable dry powder particles under the influence of e.g. gravity. Dispersing does not encompass active particle transfer and/or deposition methods such as spraying, electrostatic coating, and the like.

By a stencil roll is meant a roll comprising a shell comprising a plurality of through-apertures that extend therethrough in a predetermined pattern, so that flowable dry powder particles can pass through the through-apertures.

By an array is meant a population of dry powder particles disposed on (e.g., attached to) a substrate in a pattern (which pattern may be e.g. regular or irregular).

Shown in side schematic cross sectional view in FIG. 1 is an exemplary apparatus 1 and method that can be used to deposit flowable dry powder particles 40 onto a moving substrate 30. The method relies on a hollow, rotating stencil roll 2 that rotates about an axis of rotation and that has a major radially outer surface 11 and a major radially inner surface 12. Flowable dry powder particles 40 are dispersed within interior 4 of stencil roll 2 by particle dispenser 6. Particles 40 are dispensed onto the radially inner major surface 12 of stencil roll 2, e.g. landing on a lowermost angular portion (e.g. quadrant) of major surface 12 of stencil roll (noting that this encompasses cases in which flowable dry powder particles are deposited onto/into a loose mass of already-present flowable dry powder particles located at least in a lowermost angular portion 17 of interior 4 of stencil roll 2, rather than each particle necessarily landing directly on major surface 12 of stencil roll 2). In some embodiments, the particles are gravity-dropped, meaning that they are released from dispenser 6 so as to fall freely under the influence of gravity, with no other force being imparted on the particles as they leave dispenser 6.

As stencil roll 2 rotates, a substrate 30 (e.g., a sheetlike material such as a tape backing) is brought toward stencil roll 2 so that a first major surface 33 of a first side 37 of the substrate is contacted with major radially outer surface 11 of stencil roll 2. (In some embodiments, this may be assisted by a backing roll 3, which can abut stencil roll 2 so as to form nip 5 therebetween, as in the design of FIG. 1). With radially outer surface 11 of stencil roll 2 and substrate 30 moving at the same speed along an arcuate path (so that there is essentially no slippage of substrate 30 relative to surface 11 of stencil roll 2 along the direction of motion of the two items), at least one flowable dry powder particle 40 will enter one through-aperture 13 of stencil roll 2 and pass therethrough so as to contact first major surface 33 of substrate 30. First side 37 (e.g., first major surface 33 thereof) of substrate 30 is configured so that a flowable dry powder particle 40 is attachable thereto, as described later herein in detail. Thus, as stencil roll 2 and substrate 30 follow an arcuate path, particles are distributed into through-apertures 13 and contact, and become attached to, first major surface 33 of substrate 30, e.g. as depicted in FIG. 1. Substrate 30 is separated from stencil roll 2 at separation point 18, to produce a substrate 30 comprising an array of flowable dry powder particles 40 attached to first side 37 of substrate 30.

Tumbling Freely

In many embodiments, an excess of flowable dry powder particles (i.e., a "hold-up" particle population 46) may be present e.g. in the lowermost portion (e.g. quadrant) 17 of interior 4 of stencil roll 2 (such particles, after being dispensed by particle dispenser 6, will be motivated toward that location by the Earth's gravity, indicated by arrow 15 of FIG. 1). By excess is meant that significantly more particles are present in this portion of interior 4 of stencil roll 2 than can be accommodated by the area of major surface 33 of substrate 30 that is exposed through through-apertures 13 of this portion of stencil roll 2. In at least some embodiments, such "hold-up" flowable dry powder particles are able to tumble freely within interior 4 of stencil roll 2 (motivated by the Earth's gravity) as stencil roll 2 rotates. By tumbling freely is meant that as stencil roll 2 continuously rotates, at any given time at least five percent of the particles in the hold-up population 46 of particles within interior 4 of stencil roll 2 are moving (motivated by the Earth's gravity) with respect to inner surface 12 of stencil roll 2, along a path approximately locally parallel to inner surface 12 of stencil roll 2. By tumbling freely is further meant that at least half of these moving particles are not simply sliding individually along inner surface 12 of stencil roll 2 (e.g. as a monolayer of particles) as roll 2 rotates; rather, numerous particles are present in stacks of two, three or more (e.g., considerably more) particles in depth, and encounter and collide with each other and mix with each other as they move relative to inner surface 12 of stencil roll 2.

The ability of flowable dry powder particles 40 to tumble freely can be enhanced by providing that no components such as interior walls, partitions or baffles are present in interior 4 of stencil roll 2, in spaces in close proximity to inner surface 12 of stencil roll 2 and in such manner that the components would prevent the particles from tumbling freely. Thus in at least some embodiments, operating the herein-disclosed method so that the particles tumble freely excludes any such components from being present within interior 4 of stencil roll 2. Such exclusions do not preclude e.g. supporting structural members and other ancillary items that may be present within interior 4 of stencil roll 2, as long as such items do not prevent the particles from freely tumbling. Nor is it necessarily required that inner surface 12 of stencil roll 2 must be perfectly smooth. For example, in some embodiments "lips" (which may sometimes be present in the case of through-apertures that are produced by mechanical punching or the like) may be present at or near the inner ends of at least some through-apertures 13. Such exclusions also do not preclude the use of a stencil roll that comprises a screen-printing screen (as discussed later in detail), which screen may take the form of a woven mesh that will inherently exhibit slight variations in the topography of the inner surface thereof.

It will be appreciated that in order to operate apparatus 1 so that at last some of the flowable dry powder particles freely tumble as described above, it may not necessarily be sufficient to omit such components (e.g., partitions or baffles within the interior of stencil roll 2) as would obviously prevent free tumbling. Rather, various operating parameters (e.g. the angular speed of rotation of stencil roll 2 in combination with the diameter of stencil roll 2, the rate of dispensing of particles 40 into the interior of stencil roll 2, and the volume of hold-up population 46 of particles that are maintained within the interior of the stencil roll) may be set in particular ranges in order to provide that the particles freely tumble in operation of the method, as will be appreciated by the ordinary artisan. It will also be appreciated that the conditions under which free tumbling is present may in some instances depend on certain properties of the particles themselves (e.g. static charge) as well as the environment in general (e.g., relative humidity). The ordinary artisan will understand that all such particle properties, process parameters and general conditions, can be chosen in order that the flowable dry powder particles freely tumble during operation of the process.

In particular embodiments, at least some of the freely tumbling flowable dry powder particles 40 of hold-up population 46 may form a readily identifiable "rolling bank" 41 (such a rolling bank is akin to the rolling banks encountered in various types of liquid coating operations; as such, this term will be readily understood by the ordinary artisan).

It will be appreciated that allowing the hold-up particle population 46 to tumble freely within the interior of stencil roll 2 can serve to keep particles 40 uniformly mixed and in particular can minimize any stratification of the hold-up particle population 46 into larger and smaller sized particles. Allowing the hold-up dry powder particles to form a rolling bank may be particularly effective in this regard. Still further, allowing the hold-up particle population 46 to tumble freely, e.g. to form a rolling bank, may enhance the degree to which the particles are uniformly spread along the long axis of the stencil roll.

In some embodiments, apparatus 1 may include at least one particle-contacting member 7 that at least closely abuts (and may actually touch) major radially inner surface 12 of stencil roll 2 but is not attached to stencil roll 2 so as to rotate along with stencil roll 2. Member 7 may assist in dislodging at least some flowable dry powder particles 40 from the major radially inner surface 12 of the stencil roll (e.g. overcoming any static friction forces and/or slight electrostatic forces that might tend to keep particles 40 in place on a given location of inner surface 12) so that the particles can tumble freely within interior 4 of stencil roll 2 as stencil roll 2 rotates. At the same time, member 7 avoids dislodging any particles that have traveled into through-apertures 13 so as to contact and bond to substrate 30. Thus, in specific embodiments, any particles 40 that have traveled into and through apertures 13 and have bonded to substrate 30, are not dislodged or removed from substrate 30, either by gravity or by member 7. It will be appreciated that this can enhance the fidelity with which the particles are deposited and retained on the substrate in a desired pattern.

Member 7 may have any suitable design although it may conveniently exhibit a long axis that is at least generally parallel to the long axis (e.g., the axis of rotation) of stencil roll 2. In some embodiments, member 7 may comprise a plurality of fibers, filaments, bristles or the like. In some specific embodiments, member 7 may comprise at least one brush. In other specific embodiments, member 7 may comprise a fibrous surface (e.g., analogous to a paint roller). In still other embodiments, member 7 may take the form of, e.g. a scraper, blade, squeegie, or like item. In various embodiments, such a member may be non-moving; or, it may rotate in a direction opposite the direction of rotation of stencil roll 2 or in the same direction as stencil roll 2. Such a member may also be oscillated (e.g. rotationally and/or longitudinally) rather than rotated continuously. In various embodiments, a member 7 may be positioned at an angular distance, along the direction of rotation of the stencil roll, of from about 30 degrees to about 100 degrees from a gravitationally lowest point of the stencil roll. (By way of specific example, member 7 of FIG. 1 is mounted at an angular distance of about 80 degrees from the gravitationally lowest point 17 of stencil roll 2.)

In some embodiments, member 7 may be configured to (either in addition to, or instead of, dislodging flowable dry powder particles 40 from the major radially inner surface 12 of the stencil roll) assist in motivating flowable dry powder particles to move radially outward through apertures 13 and/or urging such particles against first major surface 33 of substrate 30 to be bonded thereto. (Depending on the amount of radially outward pressure that might be imparted on stencil roll 2 by such a member, a backing roll can be placed radially outward of stencil roll 2 at that location to provide appropriate balancing of forces if desired.)

In some embodiments (whether or not a member 7 is present) apparatus 1 does not include any sort of mechanical device that periodically vibrates, strikes or taps stencil roll 2 (e.g., radially outer surface 11 thereof) to dislodge particles from radially inner surface 12 thereof. In other embodiments, stencil roll 2 may be vibrated or tapped at a desired location (e.g. between the 9 o'clock and 11 o'clock positions of a stencil roll of the type shown in FIG. 1) to enhance the dislodging of particles from radially inner surface 12 thereof.

In some embodiments, after substrate 30 has become separated from stencil roll 2, moving air may be impinged on major surface 33 of substrate 30 in order to promote the removal of any particles 40 that may be resting on major surface 33 (and/or resting atop other particles 40) without having become securely bonded to major surface 33. In addition to this, or instead of this, moving air may be removed from the vicinity of substrate 30 so that any particles that might be entrained in the air may be prevented from undesirably contacting major surface 33. Such moving air may be provided by any suitable arrangement, e.g. one or more air knives, vacuum hoses or shrouds, and so on. In other embodiments, no moving air of any kind may be used in such manner.

Figure 2:
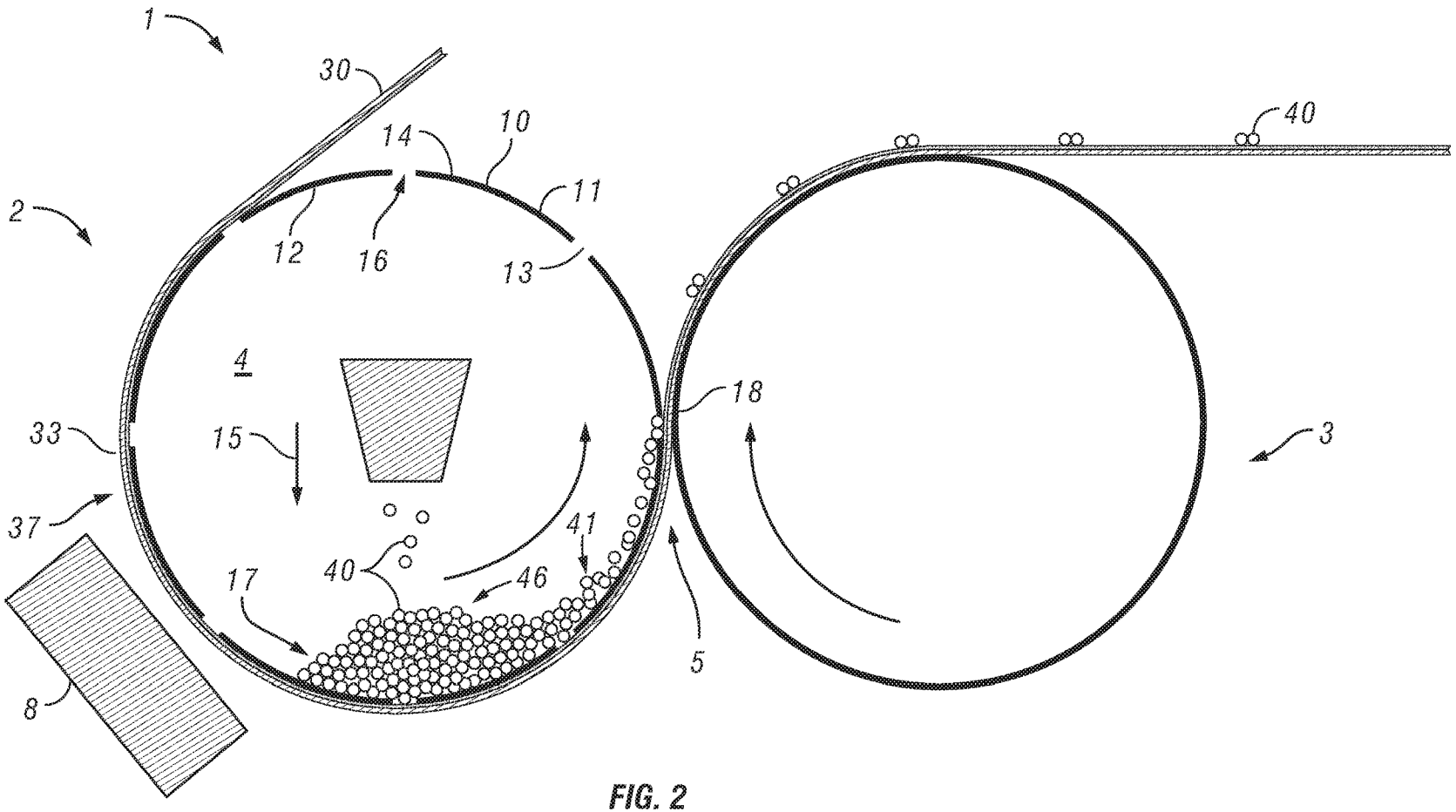
FIG. 2 is a side schematic cross sectional view of another exemplary apparatus and process that can be used to deposit flowable dry powder particles onto a moving substrate.

FIG. 2 depicts in exemplary embodiment an arrangement of a particle deposition apparatus and method that differs slightly from that of FIG. 1. In the embodiment of FIG. 2, the incoming substrate 30 is wrapped against the radially outer surface 11 of stencil roll 2, at a free location of roll 2 rather than at a nip as in FIG. 1. In this design, the separation point 18 at which substrate 30 is detached from surface 11 of roll 2, is at nip 5 between stencil roll 2 and a backing roll 3. Also, no particle-contacting member is present in the exemplary design of FIG. 2. Otherwise, the descriptions above all apply to the apparatus and method shown in FIG. 2.

The contact point at which substrate 30 is first contacted with surface 11 of stencil roll 2 (whether such a contact point is proximate a nip 5 as in the design of FIG. 1, or is along a free portion of roll 2 as in the design of FIG. 2), may be located at any suitable angular location along the arcuate path of surface 11 of roll 2. In various embodiments, such a contact point may be located at between a 9 o'clock and a 3 o'clock position (using conventional terminology with 12 noon signifying an uppermost position 16 of stencil roll 2), or between a 10 o'clock and a 2 o'clock position when viewed as in FIG. 1. In specific embodiments, such a contact point is positioned so that substrate 30 is traveling in a downward direction at the contact point (as in FIGS. 1 and 2).

The separation point 18 at which substrate 30 is detached from surface 11 of stencil roll 2, may be located at any suitable angular location along the arcuate path of surface 11 of roll 2. In various embodiments, the separation point 18 may be located at between a 9 o'clock and a 3 o'clock position (using conventional terminology with 12 noon signifying an uppermost position 16 of stencil roll 2), or between a 10 o'clock and a 2 o'clock position when viewed as in FIG. 1. In specific embodiments, separation point 18 is positioned so that substrate 30 is traveling in an at least generally upward direction at the separation point.

The concept of first major surface 33 of substrate 30 "contacting" radially outer surface 11 of stencil roll 2, by definition requires that there is essentially no slippage of substrate 30 relative to surface 11 of stencil roll 2 along the direction of motion of surface 11 and surface 33 during the time that substrate 30 is in contact with stencil roll 2. This can advantageously ensure that particles are not deposited on surface 33 of substrate 30 so as to exhibit a "comet tail" e.g. along the direction of movement of the substrate. Furthermore, in some embodiments, essentially all particles 40 that are not attached to surface 33 of substrate 30 may be dislodged from radially inner surface 12 of stencil roll 2 (e.g. by the Earth's gravity, by way of particle-contacting member 7, or by some combination thereof) and tumble freely away from that area of surface 12, before substrate-roll separation point 18 is reached. This can additionally ensure that very few loose particles may inadvertently be expelled through apertures 13 so as to reach substrate 30 in the short time after substrate 30 is separated from stencil roll 2 but is still relatively close thereto. In other words, the arrangements disclosed herein can provide that, in some embodiments, the flowable dry powder particles are contacted with (and attached to), essentially only the specific areas of surface 33 of substrate 30 that were in overlapping relation with through-apertures 13 of stencil roll 2. This again can minimize any inadvertent spreading, spraying or smearing of the particles and can allow the particles to be deposited on substrate 30 in a very well-controlled array if desired. Thus in various embodiments, less than about 50, 30, 20, 10, or 5% by number of the flowable dry powder particles are attached to areas of first major surface 33 of substrate 30 that had come into contact with (land areas 14 of) radially outer major surface 11 of stencil roll 2 (as opposed to being attached to areas that were in overlapping relation with through-apertures 13 of stencil roll 2).

Figure 3:
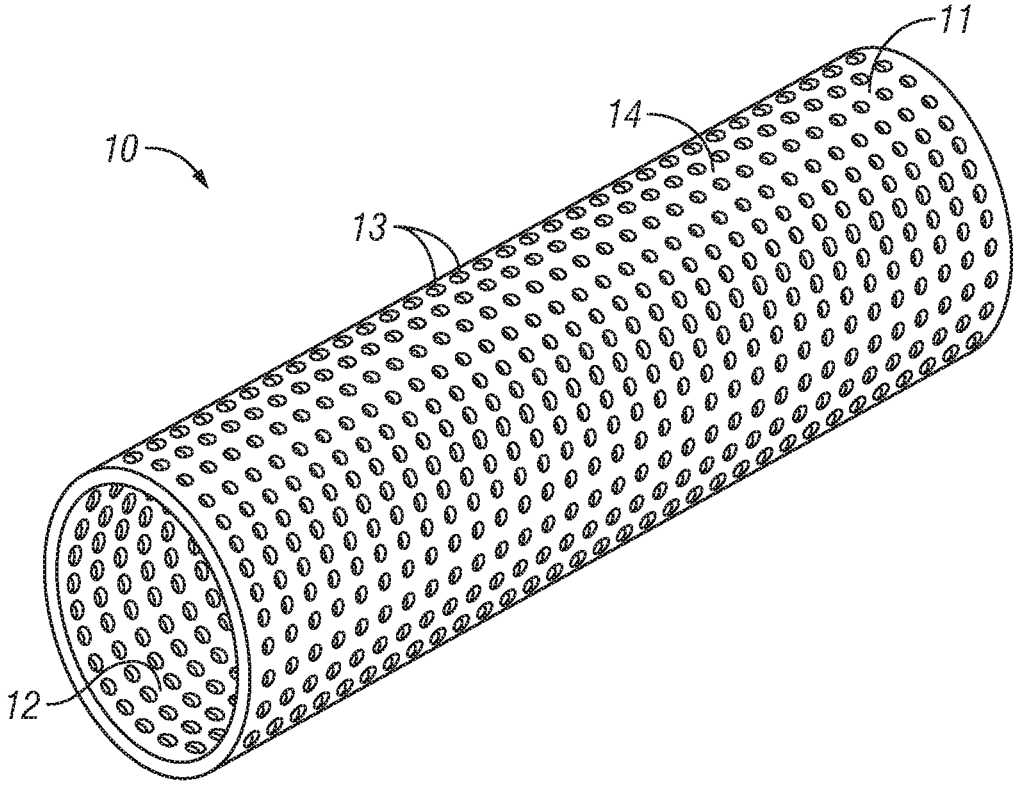
FIG. 3 is a side perspective view of an exemplary stencil shell of a stencil roll.

In some embodiments stencil roll 2 may rely on a stencil shell (e.g., a metal sleeve, such as a nickel sleeve, that slips onto a support grid) 10 of the general type depicted in FIG. 3. Shell 10 may be supported by any suitable interior frame or set of support members that allow flowable dry powder particles to be distributed to radially inner surface 12 of shell 10. In embodiments in which shell 10 is sufficiently strong and rigid, shell 10 may be supported mainly, or essentially completely, by endcaps or endrings to which longitudinal ends of shell 10 are attached so as to form stencil roll 2. Shell 10 may comprise numerous through-apertures 13, separated from each other by land areas 14 (which will provide the radially outermost surface of stencil roll 2 against which the major surface 33 of substrate 30 is contacted). Through-apertures 13 may be provided in any desired pattern and shape and may be of any suitable size (i.e. diameter or equivalent diameter in the case of apertures that are not circular). In many embodiments the radial thickness (along a radially inward-outward direction) of such apertures may be set by e.g. the thickness of a stencil shell 10. This thickness may be chosen in relation to the size of the particles (and other aperture parameters such as size and shape may also be chosen) e.g. to govern the rate at which particles can be passed therethrough.

In some embodiments, at least selected apertures of the stencil roll may be configured (e.g. to have a particular size and/or shape and/or length) so that flowable dry powder particles can pass through each selected aperture only one at a time, so that for each complete rotation of the stencil roll, only one flowable dry particle is passed through each selected aperture to be attached to the major surface of the substrate. (An idealized representation of such an arrangement is depicted in FIG. 1.) In other embodiments, at least selected apertures of the stencil roll may be configured so that multiple dry powder particles can pass through each selected aperture at a time, so that for each complete rotation of the stencil roll, multiple flowable dry powder particles are passed through each selected aperture to be attached to the major surface of the substrate. (An idealized representation of an arrangement in which two particles are passed through each aperture for each rotation of the stencil roll is depicted in FIG. 2.). In further embodiments, at least selected apertures may be configured so that a substantial number of particles (e.g., 4, 6, 10, 20, 40 or more) are passed through each selected aperture during a complete rotation of the stencil roll.

Regardless of the particular arrangement, in at least some embodiments the aperture parameters may be chosen, and the operating parameters of the method likewise chosen, to provide that substantially or essentially all particles 40 that enter an aperture 13 but are not attached to surface 33 of substrate 30, are dislodged from the aperture (e.g. by the Earth's gravity, by way of particle-contacting member 7, or by some combination thereof) so as to tumble freely away from the aperture, before substrate-roll separation point 18 is reached. In other words, in at least such embodiments the apertures do not function as "pockets" within which particles that are not attached to surface 33 of substrate 30 may nevertheless remain in place in the aperture as the drum rotates.

The radial length (e.g., as dictated by the radial thickness of a shell 10) of apertures 13 may be e.g. from about 20 μm to about 4 mm. In further embodiments, the radial length is at least about 50 μm, or 0.1, 0.2, 0.4, 0.6, 0.8, or 1.0 mm. In additional embodiments, the radial length is at most about 3.0, 2.5, 2.0, 1.5, or 1.0 mm. In some embodiments apertures 13 may be tapered with a wide portion and a narrower throat. In such cases, the length of the throat can be any of the above values. In various embodiments, the shape of apertures 13 may be e.g. circular, square, rectangular, irregular, and so on, as desired. In various embodiments, the size of apertures 13 may be from about 20 μm to about 100 mm in diameter (or equivalent diameter). In various embodiments, apertures 13 exhibit a diameter of at least about 50 μm, or 0.1, 0.2, 0.4, 0.8, or 1.0 mm; in further embodiments, apertures 13 exhibit a diameter of at most about 40, 20, 10, 3.0, 2.0, 1.0, 0.8, 0.6, or 0.4 mm.

The apertures may be present in any desired pattern and spacing over any desired portion of stencil roll 2. Such a pattern may be regular (e.g., a square array or hex array) or irregular as desired. The apertures may occupy any desired percentage of the total working surface area of stencil roll 2. In various embodiments, the apertures may occupy at least about 5, 10, 20, 30, or 40% of the total working surface area of roll 2. In further embodiments, the apertures may occupy at most about 70, 60, 50, 40, 30, 20, 10, or 5% of the total working surface area. In some embodiments, apertures 13 may be present as a mixture of different shapes, sizes, spacings, and so on.

Figure 4:
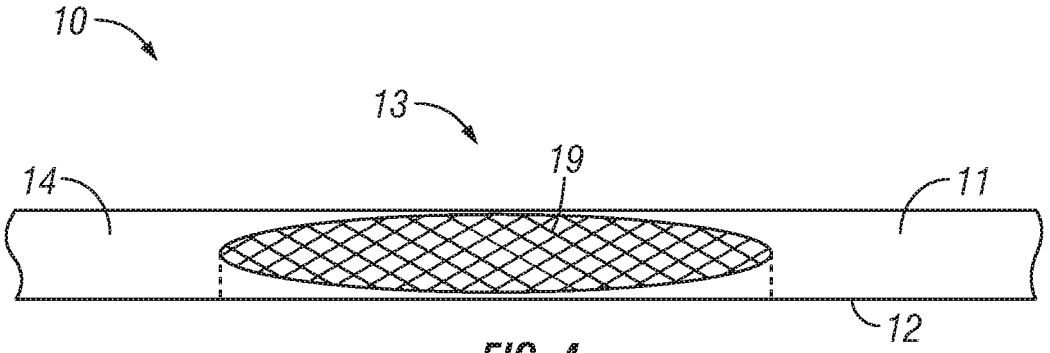
FIG. 4 is a perspective, isolated view of a portion of an exemplary stencil shell with apertures comprising sub-apertures.
Figure 6:
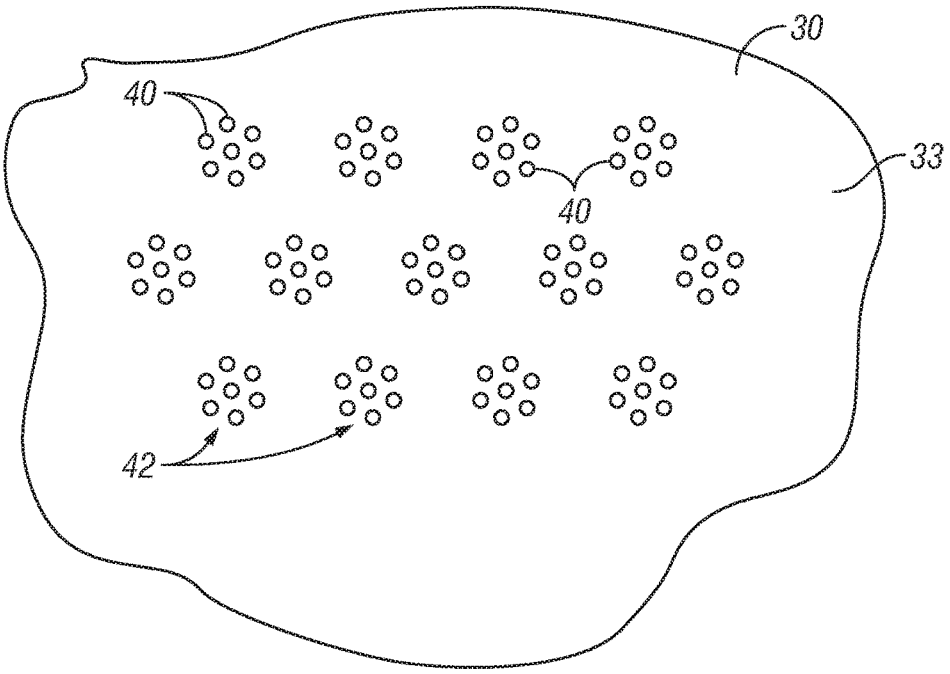
FIG. 6 is a top view of an exemplary substrate with flowable dry particles attached thereto, the dry powder particles being present on the substrate as a nested array.

In some embodiments, at least some apertures 13 of stencil roll 2 may each comprise a plurality of sub-apertures, at least selected sub-apertures being sized so as to allow at least one flowable dry powder particle 40 to pass therethrough at a time, so that the method causes a plurality of flowable dry powder particles 40 to be attached to the major surface of the substrate as a nested array. Such an arrangement is depicted in exemplary embodiment in FIG. 4, which depicts an isolated view of a portion of a stencil roll shell 10 containing an aperture 13. Aperture 13 comprises sub-apertures 19 (which may be defined by any suitable sheetlike material with sub-apertures extending therethrough; e.g. a microperforated metal screen or the like). It will be appreciated that the use of an aperture with sub-apertures in this manner can allow flowable dry powder particles 40 to be deposited to form patterns such as shown in exemplary manner in FIG. 6. Such patterns will be known as a nested array, in which individual particles 40 are grouped into clusters 42 (each cluster being comprised of particles 40 that passed through sub-apertures of a particular aperture), with the arrangement of the individual particles 40 in each cluster 42 being dictated by the pattern of the sub-apertures.

In particular embodiments in which apertures comprise sub-apertures, the apertures may be macroscopically sized in order to deposit flowable dry particles onto a substrate in large-scale pattern e.g., with desired overall shapes and sizes. For example, activated carbon particles might be deposited onto a filtration web in a macroscopic pattern in which particles are present in filtration areas but are absent in areas in which the web is to be e.g. ultrasonically bonded to components of a respirator mask. Thus at least in such embodiments, the apertures of stencil roll 2 may have a minimum size, along at least one dimension, of at least about 5 mm, 10 mm, or 2, 4, 6, or 8 cm.

Figure 5:
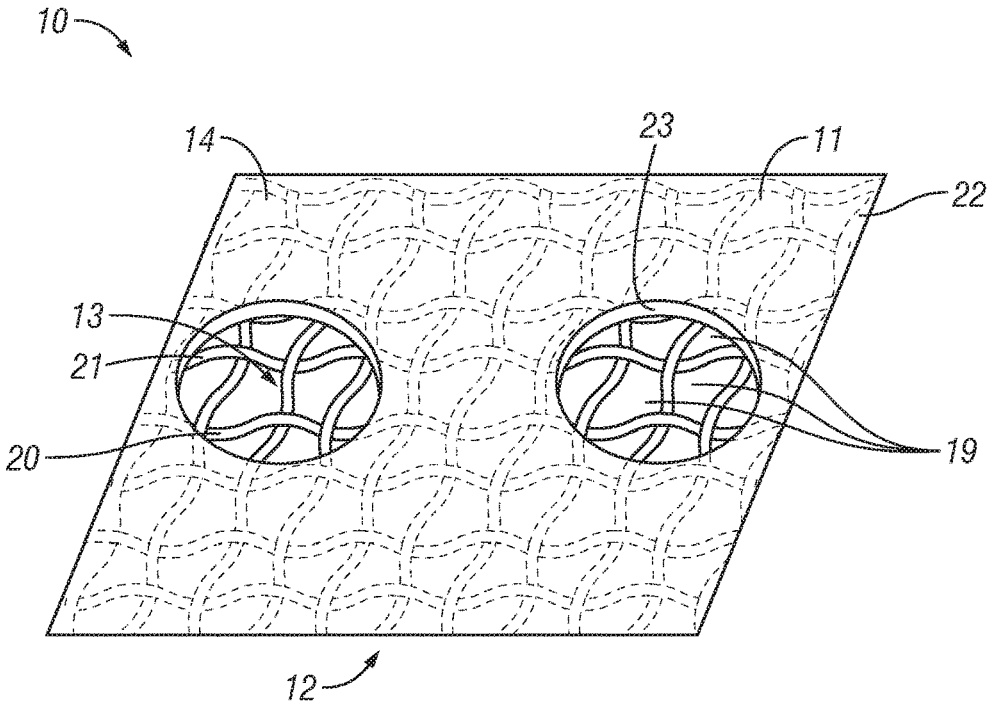
FIG. 5 is a perspective, isolated view of a portion of another exemplary stencil shell with apertures comprising sub-apertures.

Still another exemplary arrangement is shown in FIG. 5. It has been found that a screen-printing screen may suitably serve as a stencil shell 10 of a stencil roll 2. Many such screen-printing screens rely on a mesh screen 20 comprised of filaments 21. A hardenable material (e.g. a photoemulsion) 22 is coated on the mesh screen except in areas where it is desired to preserve permeability, and is hardened. A hardened emulsion 22 can comprise interior edges 23 that define areas of the screen-printing screen 20 that do not have hardened emulsion thereon, which areas provide apertures 13 of stencil shell 10. It will be appreciated that such an approach can inherently provide a stencil roll shell with apertures 13 that include sub-apertures 19 (as defined by the openings between filaments 21). However, in some specific embodiments, stencil roll 2 does not comprise a screen-printing screen.

In at least some embodiments, it has been found advantageous for outer surface 11 of stencil roll 2 (e.g., of shell 10) to exhibit release properties (specifically, in the land areas 14 that are interspersed between apertures 13). Any suitable release coating, treatment, or the like may be used. Such a release coating or treatment might rely on e.g. silicone materials, hydrocarbon materials, diamond-like carbon materials, fluorinated materials such as poly(tetrafluoroethylene), or the like. Such release properties may be achieved by coating (e.g., of a liquid-borne coating solution or dispersion); or, by any other suitable method of deposition. In the present work it has also been found that at least some hardened screen-printing emulsions can exhibit adequate release properties, without any specific treatment or coating being necessary thereon.

Substrate 30 may be comprised of any suitable material or materials and may take any suitable form. In some embodiments, substrate 30 may be a continuous substrate, e.g. a web (e.g., film, foil, nonwoven, and so on) that is supplied from a roll. In other embodiments, substrate 30 may be a discontinuous substrate, e.g. that is sheet-fed rather than roll-fed.

In some convenient embodiments, substrate 30 may be configured so that at least a portion of its thickness can be heated to promote attachment of flowable dry powder particles 40 to substrate 30. Thus, the method may involve contacting first major surface 33 of first major side 37 of a moving substrate 30 with major radially outer surface 11 of rotating stencil roll 2. Thermal energy may be imparted to a first portion 135 (most easily seen in FIGS. 7 and 8) of first major side 37 of moving substrate 30 at least while first major surface 33 of first major side 37 of moving substrate 30 is in contact with major radially outer surface 11 of the hollow, rotating stencil roll. This may be accomplished e.g. by directly impinging thermal energy onto first major surface 33, e.g. by use of an infrared (IR) source mounted within stencil roll 2 so that infrared radiation passes through the apertures in roll 2 to encounter substrate 30 or by maintaining stencil roll 2 at a high temperature in locations in which it is in contact with substrate 30; or, by any other suitable manner. Alternatively, this may be accomplished by indirectly transferring thermal energy to first major surface 33, for example, by impinging thermal energy on second major surface 34 of substrate 30, so that the thermal energy is conducted through the thickness of substrate 30 to reach first portion 135 and first major surface 33 of substrate 30. Combinations of both approaches may be used. In some embodiments substrate 30 may be preheated (for example, by using a heated backing roll 3) before substrate 30 comes into contact with stencil roll 2. In the specific embodiment of FIG. 1, an infrared heater 8 is used to transmit thermal energy onto second major surface 34 of substrate 30, which thermal energy can then be conducted across the thickness of substrate 30 so as to heat first portion 135 and first major surface 33 to a desired degree. However, any suitably controllable heating unit may be used, e.g. a flashlamp, hot-air blower, flame treater, and so on.

However achieved, a first portion 135 of first major side 37 of substrate 30, which first portion 135 includes first major surface 33 (and extends continuously along the downweb length of substrate 30; and, in various embodiments, extends inwardly into substrate 30 therefrom a distance not more than 70, 60, or 50% of the total thickness of substrate 30), is heated to a temperature sufficient to soften first portion 135 of substrate 30. In this manner, major surface 33 of first side 37 of substrate 30, as well as first portion 135 that extends inwardly toward the interior of substrate 30 therefrom, are transformed into a configuration in which flowable dry powder particles can be slightly embedded thereto and attached thereto, as shown in exemplary embodiment in FIGS. 7 and 8.

As substrate 30 rotates with stencil roll 2, at least some flowable dry powder particles 40 pass through at least some apertures 13 in stencil roll 2 so as to contact the softened first major surface 33 of the moving substrate and to partially embed in first portion 135 of the substrate and to attach thereto. As this happens, flowable dry powder particles 40 that have not become attached to first major surface 133 of moving substrate 30 are allowed to tumble freely within the interior 4 of the stencil roll as the stencil roll rotates as noted earlier herein.

Figure 7:
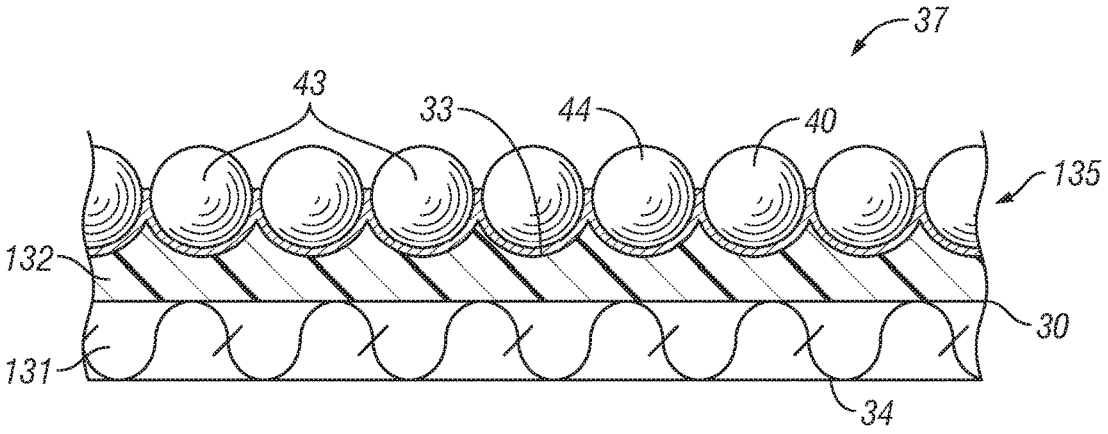
FIG. 7 is a side schematic cross sectional view of an exemplary multilayer substrate with flowable dry powder particles attached thereto and partially embedded therein.
Figure 8:
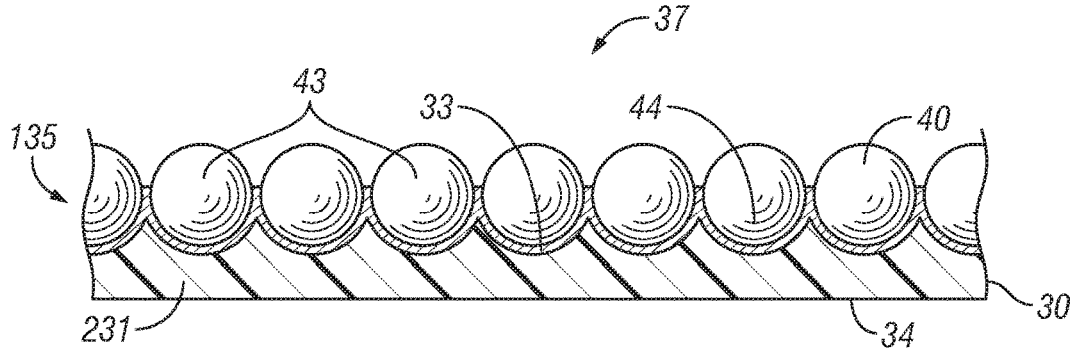
FIG. 8 is a side schematic cross sectional view of an exemplary monolithic substrate with flowable dry powder particles attached thereto and partially embedded therein.

Particles 40 may thus be partially embedded in substrate 30 so as to exhibit an embedded portion 44 and a protruding portion 43 as shown in idealized representation in FIGS. 7 and 8. By partially embedded is meant that a particle penetrates partially into first portion 135 of substrate 30 (toward the interior of substrate 30) relative to first major surface 33 of substrate 30, an amount (referred to herein as an embedment percentage) that is from about 5% to about 70% of the diameter (or average diameter) of the particles. By way of specific example, the particles of FIG. 7 appear to be partially embedded within substrate 30 so as to exhibit an embedment percentage of about 60%. In various embodiments, the embedment percentage can be at least about 10, 15, 20, 25, or 30% (based on the average embedment depth and average diameter or equivalent diameter of the particles). In further embodiments, the embedment percentage can be at most about 70, 60, 50, 40, or 30%.

In some embodiments as shown in exemplary illustration in FIG. 7, substrate 30 may comprise a first layer 132 that is a softenable material and to which particles 40 can be attached, and a second layer 131 that is primarily a support material that may not soften appreciably during the processing described herein. In such embodiments, substrate 30 may be a multilayer substrate with a first layer 132 that provides first major surface 33 of substrate 30, and is comprised of a material that is softenable at a first softening temperature, and with a second layer 131 that is a support layer and that is not softenable at a temperature of less than 30 degrees C. above the first softening temperature of the first layer. In other words, if second layer 131 exhibits a readily identifiable softening temperature (noting that in some embodiments second layer 131 may be a thermoset polymeric material that may e.g. decompose before reaching a well-defined softening point), that softening temperature is at least 30 degrees C. higher than the softening temperature of first layer 132. In various embodiments, second layer 131 is not softenable at a temperature of less than 40, 60, 80, 100, or 120 degrees C. above the first softening temperature of first layer 132.

In various embodiments, first layer 131 may be comprised of e.g. polyolefins (e.g., polyethylene (of any suitable density), polypropylene, and blends and copolymers thereof) or the like. In various embodiments, the second layer 132 may be comprised of e.g. polyesters or the like. In some specific embodiments, a polyethylene first layer may exhibit a softening point (e.g., a melting point) in the range of 115 to 135° C., and a polyethylene terephthalate second layer may exhibit a softening point (e.g., a melting point) in a range of 240 to 270° C. In general, any suitable material, e.g. paper, organic polymeric materials and the like, and whether in the form of e.g. a nonporous film or a porous web (e.g., a woven, non-woven, or knitted material) may be used as a second layer 132.

In an alternative embodiment, substrate 30 may be a monolithic substrate rather than a multilayer substrate, as illustrated in FIG. 8. In such embodiments, the entire thickness of substrate 30 may be comprised of a material with a constant softening point, with the parameters (e.g., the amount and rate of thermal energy imparted to the first side of the substrate, the thickness of the substrate, and so on) of the method being controlled so that a first portion 135 of first major side 37 of the substrate (which first portion includes first major surface 33), is heated to a temperature sufficient to soften first portion 135 while a second (backside) portion 231 of the substrate remains substantially unsoftened. Unsoftened backside portion 231 thus allows substrate 30 to retain sufficient mechanical integrity to be processed via conventional web-handling methods. (It will be appreciated that with a monolithic substrate 30, it may be most suitable to direct thermal energy into first portion 135 from first major side 37 of substrate 30 rather than from the opposite major side.) Flowable dry powder particles may then be disposed on softened first portion 135 to be partially embedded therein and attached thereto as discussed earlier. Such an approach may produce a product of the general type shown in exemplary embodiment in FIG. 8. In some embodiments, a monolithic substrate 30 may be comprised of any suitable polyolefin or copolymer or blend thereof. In specific embodiments, a monolithic substrate 30 may be comprised of polyethylene.

Regardless of which general approach is used, the attaching of particles 40 to a softenable surface 33 and first portion 135 of substrate 30 may occur by any suitable mechanism that is not pressure-sensitive adhesive bonding nor is bonding by any kind of chemically-activated or photo-activated process. Rather, the particles are retained in place by way of (after the particles have penetrated partially into first portion 135 of substrate 130) cooling the substrate so that the previously-softened material of first portion 135 hardens. The retaining of the particles in their partially embedded condition may occur by any combination of e.g. surface forces, mechanical forces, and the like. In some embodiments, sufficient thermal energy may be used that first portion 135 of substrate 30 becomes at least semi-liquid rather than merely being softened. This may enhance the ability of the particles to be partially embedded (e.g., by way of the at least semi-liquid material of first portion 135 wetting onto the surface of the particles) in substrate 30.

Flowable dry powder particles 40 may be of any suitable type, composition, size, and shape. In some embodiments, particles 40 may exhibit an average particle size (diameter or equivalent diameter) of from about 0.1 μm to about 5 mm. In further embodiments, particles 40 may exhibit an average particle size of at least about 0.2 μm, 0.5 μm, 1 μm, 10 μm or 100 μm. In various embodiments, particles 40 may exhibit an average particle size of at most about 4, 3, 2, 1, or 0.5 mm. The shape of particles 40 is not particularly limited, although in many embodiments particles 40 may be spherical or somewhat spherical in shape (e.g., with an aspect ratio of maximum dimension to minimum dimension along orthogonal axes of less than about 1.5). In other embodiments particles 40 may be e.g. fibers or filaments e.g. with a very high aspect ratio of 10, 20, 100, 200 to 1 or more.

In some embodiments, the particles may be polydisperse, e.g. with a coefficient of variation of particle size of at least about 100%. Such particles may be polydisperse as obtained; or, a population of desired polydispersity (e.g. a bimodal or higher-order modal population, e.g. with two or more readily identifiable major peaks in a particle-size distribution) may be obtained by mixing two or more particle size populations with each other.

In some embodiments, flowable dry powder particles 40 may include organic polymeric particles. In specific embodiments, such organic polymeric particles 40 may be comprised of relatively hydrophilic materials (e.g. hydroxypropylmethylcellulose, hydroxyethylcellulose, cellulose, poly (ethylene glycol), guar gum, xanthan gum, and so on), and may function e.g. as water-wettable or water-absorbent or water-swellable materials. In other specific embodiments such organic particles may be comprised of relatively hydrophobic materials such as e.g. various latex beads, poly (methylmethacrylate) or polystyrene beads, e.g. for various optical or chromatography applications. In general, any a flowable dry powder of any organic polymeric composition may be used, e.g. cellulose derivatives such as cellulose acetate, polyolefins such as polypropylene, polyethylene, and blends and copolymers thereof, and so on. Combinations and mixtures of any of these may be used.

In some embodiments, particles 40 may include any desired inorganic particles, e.g. mineral pigments or fillers, e.g. titania, calcium carbonate, talc, kaolin clay, barium sulfate, and so on. In particular embodiments inorganic particles 40 may include at least some solid spherical glass microspheres (e.g., beads), hollow glass bubbles, ceramic microspheres, or the like. In specific embodiments, such inorganic particles may be at least partially reflective (e.g., silver-coated), for use in applications involving reflectivity or retro-reflectivity. In particular embodiments, particles 40 may be chosen from any of the compositions, size ranges, and arrangements described in Patent Application Publication No. US 2015-0232646 to Walker, J R., and in PCT Patent Application Publication WO 2015/123526, which are incorporated by reference herein in their entirety for this purpose.

In specific embodiments, particles 40 may include carbon black, graphite, activated carbon and like materials, which may be used e.g. as sorbents, filtration media, reinforcing fillers, and so on. In other specific embodiments, particles 40 may include abrasive particles, of any suitable composition and grade. In some embodiments, particles 40 (of any suitable composition and size) may be used as spacers, e.g. temporary or permanent spaces, in in laminating substrates together. In various embodiments, combinations and mixtures of inorganic particles and organic particles may be used.

Any suitable article may be produced that includes particles that are partially embedded on a substrate as described herein, for any purpose. In particular embodiments, two such articles may be joined together face to face to form a pouch or enclosure.

List of Exemplary Embodiments

Embodiment 1 is a method for attaching flowable dry powder particles to a moving substrate, the method comprising: dispersing flowable dry powder particles onto a major radially inner surface of a hollow, rotating stencil roll, contacting a first major surface of a moving substrate with a major radially outer surface of the hollow, rotating stencil roll; imparting thermal energy to the moving substrate at least while the first major surface of the moving substrate is in contact with the major radially outer surface of the hollow, rotating stencil roll, so that a first portion of the moving substrate, which first portion includes the first major surface, is heated to a temperature sufficient to soften the first portion of the moving substrate; as the moving substrate rotates with the stencil roll, allowing at least some flowable dry powder particles to pass through at least some apertures in the stencil roll so as to contact the softened first major surface of the moving substrate and to partially embed in the first portion of the moving substrate so as to become attached thereto; and, allowing at least some flowable dry powder particles that have not become attached to the first portion of the moving substrate to tumble freely along the major radially inner surface of the stencil roll as the stencil roll rotates; and, separating the first major surface of the moving substrate from the major outer surface of the hollow, rotating stencil roll so as to produce a substrate comprising an array of flowable dry powder particles attached to the first portion thereof.

Embodiment 2 is the method of embodiment 1 wherein the substrate is a multilayer substrate with a first layer that provides the first portion and first major surface of the substrate, and is comprised of a material that is softenable at a first softening temperature; and, with a second layer that is a support layer and that is not softenable at a temperature of less than 30 degrees C. above the first softening temperature of the first layer. Embodiment 3 is the method of embodiment 1 wherein the substrate is a monolithic substrate and wherein the method is performed so that when thermal energy is imparted to the moving substrate so that a first portion of the substrate, which first portion includes the first major surface of the substrate, is heated to a temperature sufficient to soften the material of the first portion of the substrate, a second portion of the substrate remains at least substantially unsoftened.

Embodiment 4 is the method of any of embodiments 1-3 wherein the imparting of thermal energy to the moving substrate so that the first portion of the substrate is heated to a temperature sufficient to soften the first portion of the substrate, is performed by an infrared heating unit. Embodiment 5 is the method of any of embodiments 1-4 wherein the imparting of thermal energy to the moving substrate includes a preheat step in which the moving substrate is heated before the first major surface of the moving substrate is in contact with the major radially outer surface of the hollow, rotating stencil roll. Embodiment 6 is the method of any of embodiments 1-5 where the particles are partially embedded in the first portion of the substrate to an embedment percentage of from about 20% to about 60%.

Embodiment 7 is the method of any of embodiments 1-6 wherein the flowable dry powder particles that tumble freely along the major radially inner surface of the stencil roll as the stencil roll rotates, form a rolling bank as the stencil roll rotates.

Embodiment 8 is the method of any of embodiments 1-7 wherein the stencil roll further comprises at least one particle-contacting member that at least closely abuts the major radially inner surface of the rotating stencil roll but is not attached to the stencil roll so as to rotate congruently therewith, which member assists in dislodging flowable dry powder particles from the major radially inner surface of the stencil roll so that the particles can tumble freely along the major radially inner surface of the stencil roll. Embodiment 9 is the method of embodiment 8 wherein the particle-contacting member is in the form of at least one brush that comprises bristles that contact the major radially inner surface of the stencil roll, wherein the brush is mounted at an angular distance, along the direction of rotation of the stencil roll, of from about 30 degrees to about 100 degrees from a gravitationally lowest point of the stencil roll.

Embodiment 10 is the method of any of embodiments 1-9 wherein the major radially outer surface of the stencil roll is a release surface.

Embodiment 11 is the method of any of embodiments 1-10 wherein at least selected apertures of the stencil roll are configured so that flowable dry powder particles can pass through each selected aperture only one at a time, so that for each complete rotation of the stencil roll, only one flowable dry particle is passed through each selected aperture to be attached to the substrate. Embodiment 12 is the method of any of embodiments 1-10 wherein at least selected apertures of the stencil roll are configured so that multiple dry powder particles can pass through each selected aperture at a time, so that for each complete rotation of the stencil roll, multiple flowable dry powder particles are passed through each selected aperture to be attached to the substrate.

Embodiment 13 is the method of any of embodiments 1-12 wherein the stencil roll comprises a stencil shell that comprises a plurality of apertures extending therethrough, and wherein the apertures exhibit a radial length, on average, of from about 20 μm to about 4 mm.

Embodiment 14 is the method of embodiment 13 wherein the stencil shell is a cylindrical screen-printing screen with a hardened screen-printing emulsion patterned thereon, wherein the hardened emulsion comprises interior edges that define areas of the screen-printing screen that do not have hardened emulsion thereon, which areas of the screen-printing screen that do not have hardened emulsion thereon provide apertures of the stencil shell.

Embodiment 15 is the method of any of embodiments 1-14 wherein the apparatus comprises a backing roll that abuts the stencil roll to form a nip, and wherein the first major surface of the substrate is separated from the major radially outer surface of the stencil roll, at a location that is angularly within plus or minus 40 degrees from the nip.

Embodiment 16 is the method of any of embodiments 1-15 wherein the dispensing of the flowable dry powder particles onto the radially inner major surface of the stencil roll comprises gravity-dropping the flowable dry powder particles onto the radially inner major surface of the stencil roll. Embodiment 17 is the method of embodiment 16 wherein the gravity-dropping comprises allowing additional flowable dry powder particles to gravity-drop onto a loose mass of flowable dry powder particles located at least in a lowermost angular portion of the interior of the rotating stencil roll.

Embodiment 18 is the method of any of embodiments 1-17 wherein the flowable dry powder particles comprise partially reflective glass beads. Embodiment 19 is the method of any of embodiments 1-17 wherein the flowable dry powder particles comprise activated carbon particles.

Embodiment 20 is the method of any of embodiments 1-19 wherein less than about 10% by number of the flowable dry powder particles are attached to areas of the first major surface of the substrate that had come into contact with the radially outer major surface of the stencil roll.

Examples

Representative Examples

A stencil roll was obtained for the patterning and deposition of flowable dry powder particles onto a continuously moving substrate. The stencil roll was made to spec by Lebanon Valley Engraving (Lebanon, Pa.). As received, the stencil roll included a cylindrical nickel shell of approximately 20 cm in diameter. The thickness of the nickel shell was approximately 0.3 mm, with through-apertures being provided through the thickness of the shell in the pattern described below. Aluminum end rings and gears were mounted to each end of the stencil roll to provide structural support and to allow the stencil roll to be rotated at a desired speed. Nanomold QC15 Mold Release obtained from Nanoplas Inc. (Grandville, Mich.) was applied to the outer surface of the stencil shell. The stencil roll was installed into a continuous web-processing line obtained from Hirano Techseed, in a configuration generally similar to that depicted in FIG. 2.

The stencil roll as obtained from the vendor included a deposition aperture pattern that occupied an area of approximately 5 cm width along the long axis of the stencil roll and that extended circumferentially around the stencil roll along that portion of the width of the stencil roll. The aperture pattern consisted of circular through-apertures in a square lattice, with a circle diameter of 1.3 mm and a center-to-center spacing of 2.0 mm.

A continuous substrate was obtained of the general type described on page 21 of PCT Patent Application Publication WO 2015/123526. The substrate was multilayer, comprising a polyester first layer of approximately 100 μm thickness and a polyethylene second layer of approximately 25 μm thickness. The substrate was threaded into the web-processing line so as to bring the polyethylene surface of the substrate into contact with the outer surface of the stencil roll. An infrared heating lamp was placed between 0.5 and 2 inches from the outer surface of the stencil roll in a location similar to that shown in FIG. 1. The infrared lamp was then turned on and set to a power setting such that the substrate, while contacting the stencil roll, reached a temperature (measured using a Scotchtrak Infrared Heat Tracer (3M Corporation, Maplewood, Minn.)) of approximately 160° C.-180° C. The line speed was set to approximately 1.0-1.5 m/min.

Approximately 10 to 20 g of silane-treated borosilicate glass microspheres (of the general type described on pages 19 and 21 of PCT Patent Application Publication WO 2015/123526, and estimated to have an average particle size in the range of approximately 40-80 μm) was inserted into the interior of the stencil roll (through an opening in one of the endcaps) in a single dose. As the stencil roll rotated, it was observed that these flowable dry powder particles tumbled freely and that the hold-up population formed a readily identifiable rolling bank. As the substrate followed its web path along the underside of the stencil roll and was then separated from the stencil roll, it was observed that dry powder particles (glass beads) had become partially embedded in the substrate, according to the deposition pattern described above. Thus, under these conditions, the polyethylene layer of the multilayer substrate had become softened (e.g., at least semi-molten) during the time that the substrate was in contact with the stencil roll, so that the polyethylene surface was receptive to particles becoming partially embedded therein.

Figure 9:
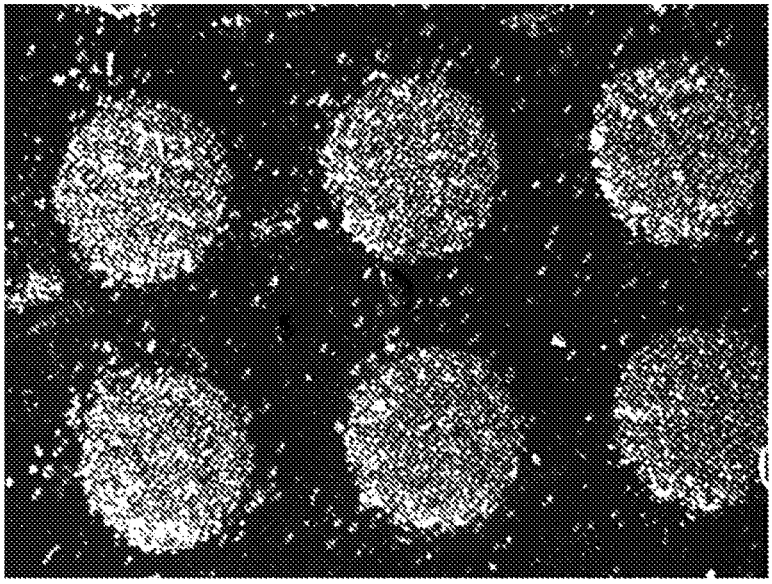
FIG. 9 presents an optical micrograph of an experimentally produced substrate with flowable dry powder particles (glass microspheres) attached thereto.

The continuous substrate with glass beads partially embedded therein, after being separated from the stencil roll, was passed through a 10 foot long air impingement oven set to 120° C. After leaving the oven the substrate was allowed to cool. An optical micrograph of a representative substrate bearing patterned glass beads deposited as described above is shown in FIG. 9. (Because of the prototype nature of the apparatus in this setup, some small amount of beads were found to be deposited on/attached to the substrate in areas between the main deposition areas (corresponding to the apertures in the stencil roll), as is evident from close inspection of FIG. 9.

Figure 10:
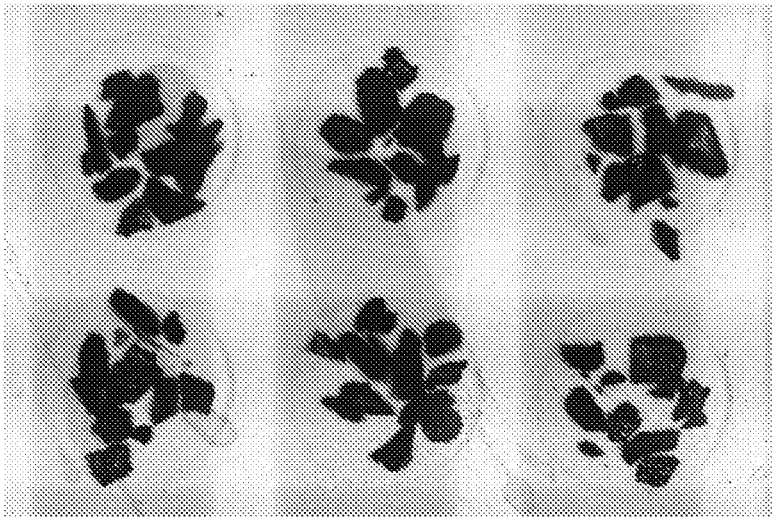
FIG. 10 presents an optical micrograph of an experimentally produced substrate with flowable dry powder particles (activated carbon) attached thereto.

A second Representative Example experiment was conducted in which 10 to 20 g of activated carbon (obtained from Kuraray and reported to have a mesh size of 40×200) was substituted for the glass beads, while all other process conditions remained the same. An optical micrograph of a representative substrate bearing patterned activated carbon particles deposited as described above is shown in FIG. 10. Comparison of FIGS. 9 and 10 reveals that due to the larger size of the activated carbon particles as compared to the glass beads, far fewer activated carbon particles were deposited in the area of the substrate corresponding to each individual aperture of the stencil roll, than occurred in the deposition of the glass beads.

Variations of the above experiments were performed. In some such experiments, the flowable dry powder particles were particles of poly(vinyl alcohol) (85,000-124,000 molecular weight; 99+ hydrolyzed).

The foregoing Examples have been provided for clarity of understanding only, and no unnecessary limitations are to be understood therefrom. The tests and test results described in the Examples are intended to be illustrative rather than predictive, and variations in the testing procedure can be expected to yield different results. All quantitative values in the Examples are understood to be approximate in view of the commonly known tolerances involved in the procedures used.

It will be apparent to those skilled in the art that the specific exemplary elements, structures, features, details, configurations, etc., that are disclosed herein can be modified and/or combined in numerous embodiments. All such variations and combinations are contemplated by the inventor as being within the bounds of the conceived invention, not merely those representative designs that were chosen to serve as exemplary illustrations. Thus, the scope of the present invention should not be limited to the specific illustrative structures described herein, but rather extends at least to the structures described by the language of the claims, and the equivalents of those structures. Any of the elements that are positively recited in this specification as alternatives may be explicitly included in the claims or excluded from the claims, in any combination as desired. Any of the elements or combinations of elements that are recited in this specification in open-ended language (e.g., comprise and derivatives thereof), are considered to additionally be recited in closed-ended language (e.g., consist and derivatives thereof) and in partially closed-ended language (e.g., consist essentially, and derivatives thereof).

Although various theories and possible mechanisms may have been discussed herein, in no event should such discussions serve to limit the claimable subject matter. To the extent that there is any conflict or discrepancy between this specification as written and the disclosure in any document incorporated by reference herein, this specification as written will control.

What is claimed is:

1. A method for attaching flowable dry powder particles to a moving substrate, the method comprising:

dispersing flowable dry powder particles onto a major radially inner surface of a hollow, rotating stencil roll, contacting a first major surface of a moving substrate with a major radially outer surface of the hollow, rotating stencil roll;

imparting thermal energy to the moving substrate at least while the first major surface of the moving substrate is in contact with the major radially outer surface of the hollow, rotating stencil roll, so that a first portion of the moving substrate, which first portion includes the first major surface, is heated to a temperature sufficient to soften the first portion of the moving substrate;

as the moving substrate rotates with the stencil roll, allowing at least some flowable dry powder particles to pass through at least some apertures in the stencil roll so as to contact the softened first major surface of the moving substrate and to partially embed in the first portion of the moving substrate so as to become attached thereto; and, allowing at least some flowable dry powder particles that have not become attached to the first portion of the moving substrate to tumble freely along the major radially inner surface of the stencil roll as the stencil roll rotates;

and, separating the first major surface of the moving substrate from the major outer surface of the hollow, rotating stencil roll so as to produce a substrate comprising an array of flowable dry powder particles attached to the first portion thereof.

2. The method of claim 1 wherein the substrate is a multilayer substrate with a first layer that provides the first portion and first major surface of the substrate, and is comprised of a material that is softenable at a first softening temperature; and, with a second layer that is a support layer and that is not softenable at a temperature of less than 30 degrees C. above the first softening temperature of the first layer.

3. The method of claim 1 wherein the substrate is a monolithic substrate and wherein the method is performed so that when thermal energy is imparted to the moving substrate so that a first portion of the substrate, which first portion includes the first major surface of the substrate, is heated to a temperature sufficient to soften the material of the first portion of the substrate, a second portion of the substrate remains at least substantially unsoftened.

4. The method of claim 1 wherein the imparting of thermal energy to the moving substrate so that the first portion of the substrate is heated to a temperature sufficient to soften the first portion of the substrate, is performed by an infrared heating unit.

5. The method of claim 1 wherein the imparting of thermal energy to the moving substrate includes a preheat step in which the moving substrate is heated before the first major surface of the moving substrate is in contact with the major radially outer surface of the hollow, rotating stencil roll.

6. The method of claim 1 where the particles are partially embedded in the first portion of the substrate to an embedment percentage of from about 20% to about 60%.

7. The method of claim 1 wherein the flowable dry powder particles that tumble freely along the major radially inner surface of the stencil roll as the stencil roll rotates, form a rolling bank as the stencil roll rotates.

8. The method of claim 1 wherein the stencil roll further comprises at least one particle-contacting member that at least closely abuts the major radially inner surface of the rotating stencil roll but is not attached to the stencil roll so as to rotate congruently therewith, which member assists in dislodging flowable dry powder particles from the major radially inner surface of the stencil roll so that the particles can tumble freely along the major radially inner surface of the stencil roll.

9. The method of claim 8 wherein the particle-contacting member is in the form of at least one brush that comprises bristles that contact the major radially inner surface of the stencil roll, wherein the brush is mounted at an angular distance, along the direction of rotation of the stencil roll, of from about 30 degrees to about 100 degrees from a gravitationally lowest point of the stencil roll.

10. The method of claim 1 wherein the major radially outer surface of the stencil roll is a release surface.

11. The method of claim 1 wherein at least selected apertures of the stencil roll are configured so that flowable dry powder particles can pass through each selected aperture only one at a time, so that for each complete rotation of the stencil roll, only one flowable dry particle is passed through each selected aperture to be attached to the substrate.

12. The method of claim 1 wherein at least selected apertures of the stencil roll are configured so that multiple dry powder particles can pass through each selected aperture at a time, so that for each complete rotation of the stencil roll, multiple flowable dry powder particles are passed through each selected aperture to be attached to the substrate.

13. The method of claim 1 wherein the stencil roll comprises a stencil shell that comprises a plurality of apertures extending therethrough, and wherein the apertures exhibit a radial length, on average, of from about 20 μm to about 4 mm.

14. The method of claim 13 wherein the stencil shell is a cylindrical screen-printing screen with a hardened screen-printing emulsion patterned thereon, wherein the hardened emulsion comprises interior edges that define areas of the screen-printing screen that do not have hardened emulsion thereon, which areas of the screen-printing screen that do not have hardened emulsion thereon provide apertures of the stencil shell.

15. The method of claim 1 wherein the apparatus comprises a backing roll that abuts the stencil roll to form a nip, and wherein the first major surface of the substrate is separated from the major radially outer surface of the stencil roll, at a location that is angularly within plus or minus 40 degrees from the nip.

16. The method of claim 1 wherein the dispensing of the flowable dry powder particles onto the radially inner major surface of the stencil roll comprises gravity-dropping the flowable dry powder particles onto the radially inner major surface of the stencil roll.

17. The method of claim 16 wherein the gravity-dropping comprises allowing additional flowable dry powder particles to gravity-drop onto a loose mass of flowable dry powder particles located at least in a lowermost angular portion of the interior of the rotating stencil roll.

18. The method of claim 1 wherein the flowable dry powder particles comprise partially reflective glass beads.

19. The method of claim 1 wherein the flowable dry powder particles comprise activated carbon particles.

20. The method of claim 1 wherein less than about 10% by number of the flowable dry powder particles are attached to areas of the first major surface of the substrate that had come into contact with the radially outer major surface of the stencil roll.

* * * * *